US009269341B1

(12) United States Patent
Lemnitsky et al.

(10) Patent No.: US 9,269,341 B1
(45) Date of Patent: Feb. 23, 2016

(54) METHOD FOR PROCESSING MUSIC TO MATCH RUNNERS TEMPO

(71) Applicant: Second Wind Technologies, Inc., Mountain View, CA (US)

(72) Inventors: Pavel A. Lemnitsky, St. Petersburg (RU); Vladimir V. Shapranov, St. Petersburg (RE); Denis Vitman, St. Petersburg (RU)

(73) Assignee: Second Wind Technologies, Inc., Mountain View, CA (US)

( * ) Notice: Subject to any disclaimer, the term of this patent is extended or adjusted under 35 U.S.C. 154(b) by 0 days.

(21) Appl. No.: 14/318,839

(22) Filed: Jun. 30, 2014

Related U.S. Application Data

(60) Provisional application No. 61/841,365, filed on Jun. 30, 2013.

(51) Int. Cl.

| | |
|---|---|
| ***G10H 7/00*** | (2006.01) |
| ***G10H 1/40*** | (2006.01) |
| ***A63B 69/00*** | (2006.01) |

(52) U.S. Cl.
CPC ..... *G10H 1/40* (2013.01); *A63B 69/0028* (2013.01)

(58) Field of Classification Search
CPC ..... G10H 1/40; A63B 69/0028
USPC ..... 482/3–9, 900, 901; 84/612; 700/94
See application file for complete search history.

(56) References Cited

U.S. PATENT DOCUMENTS

| | | | | |
|---|---|---|---|---|
| 4,337,529 | A * | 6/1982 | Morokawa | 377/20 |
| 4,788,983 | A * | 12/1988 | Brink et al. | 600/547 |
| 5,215,468 | A * | 6/1993 | Lauffer et al. | 434/236 |
| 5,267,942 | A * | 12/1993 | Saperston | 600/28 |
| 5,592,143 | A * | 1/1997 | Romney et al. | 340/309.16 |
| 6,013,007 | A * | 1/2000 | Root et al. | 482/8 |
| 6,230,047 | B1 * | 5/2001 | McHugh | 600/519 |
| 6,246,362 | B1 * | 6/2001 | Tsubata et al. | 342/357.35 |
| 6,572,511 | B1 * | 6/2003 | Volpe | 482/4 |
| 6,607,493 | B2 * | 8/2003 | Song | 600/502 |
| 6,623,427 | B2 * | 9/2003 | Mandigo | 600/300 |
| 6,808,473 | B2 * | 10/2004 | Hisano et al. | 482/8 |
| 7,003,122 | B2 * | 2/2006 | Chen | 381/67 |
| 7,177,672 | B2 * | 2/2007 | Nissila | 600/519 |
| 7,207,935 | B1 * | 4/2007 | Lipo | 600/28 |
| 2001/0003542 | A1 * | 6/2001 | Kita | 381/334 |
| 2002/0091049 | A1 * | 7/2002 | Hisano et al. | 482/148 |
| 2002/0091796 | A1 * | 7/2002 | Higginson et al. | 709/218 |
| 2005/0049113 | A1 * | 3/2005 | Yueh et al. | 482/8 |
| 2005/0126370 | A1 * | 6/2005 | Takai et al. | 84/636 |
| 2005/0129253 | A1 * | 6/2005 | Chen | 381/67 |
| 2005/0141729 | A1 * | 6/2005 | Kanzaki et al. | 381/67 |
| 2006/0084551 | A1 * | 4/2006 | Volpe, Jr. | 482/8 |
| 2006/0102171 | A1 * | 5/2006 | Gavish | 128/95.1 |
| 2006/0107822 | A1 * | 5/2006 | Bowen | 84/612 |

(Continued)

*Primary Examiner* — Jeffrey Donels

(74) *Attorney, Agent, or Firm* — Bardmesser Law Group

(57) ABSTRACT

A method for adjusting a rhythm of music to match a running rhythm of a person's steps. Even if a running rhythm changes during the same run, the rhythm of the music is changed without changing the sound and the key or the pitch of the music. A music file is converted into a universal PCM format and the fingerprint function is calculated. Repeating patterns are detected in the fingerprint function. Music tempo is estimated using data about repeating patterns. Runner's steps are analyzed using an accelerometer. Then, a special coefficient is calculated in order to either speed up or slow down the music for matching it to the rhythm of the runner's steps.

10 Claims, 4 Drawing Sheets

(56) References Cited

U.S. PATENT DOCUMENTS

2006/0111621 A1* 5/2006 Coppi et al. ..... 600/300
2006/0169125 A1* 8/2006 Ashkenazi et al. ..... 84/612
2006/0243120 A1* 11/2006 Takai et al. ..... 84/612
2006/0253210 A1* 11/2006 Rosenberg ..... 700/94
2006/0276919 A1* 12/2006 Shirai et al. ..... 700/94
2006/0288846 A1* 12/2006 Logan ..... 84/612
2007/0027000 A1* 2/2007 Shirai et al. ..... 482/8
2007/0044641 A1* 3/2007 McKinney et al. ..... 84/612
2007/0060446 A1* 3/2007 Asukai et al. ..... 482/8
2007/0074618 A1* 4/2007 Vergo ..... 84/612
2007/0074619 A1* 4/2007 Vergo ..... 84/612
2007/0079691 A1* 4/2007 Turner ..... 84/612
2007/0113725 A1* 5/2007 Oliver et al. ..... 84/612

* cited by examiner

METHOD FOR PROCESSING MUSIC TO MATCH RUNNERS TEMPO

CROSS-REFERENCE TO RELATED APPLICATIONS

This application is a non-provisional of U.S. Patent Provisional Application No. 61/841,365, filed on Jun. 30, 2013, the entire contents of which are hereby incorporated by reference.

BACKGROUND OF THE INVENTION

1. Field of the Invention

The present invention relates to a method for processing music and, more particularly, for matching a rhythm of the music to a rhythm of steps of a running or walking person.

2. Description of the Related Art

Many people like to walk or run while listening to music of their choice. However, to run or walk while using a rhythm of the music is more pleasant and more effective in terms of exercise benefit. A person gets distracted from tiredness by the music, and can run for a longer distance. Typically, a runner or a walker subconsciously attempts to match a rhythm of his movements to the music (similar to dancing or marching).

However, people run (or walk) under different conditions at various speeds. Thus, it is desired to have a rhythm of the steps always matching the music regardless of changes in tempo of the runner or changes of one song to another. The runner wants to have any music (or song) to match his running tempo. Also, if the rhythm of the music changes within the same song, it needs to be adjusted to match the rhythm of the runner.

A runner can select some music or a song, which "more or less" fits his running style. However, the runner always has to adjust his steps to match the music. This also does not work well, if a runner attempts to run intervals at various speeds. Simply slowing down or speeding up the music does not work—it produces a broken unpleasant sound similar to an old tape recorder having a stuck tape. While many people run listening to some music, none of the conventional players allow for adjusting the playback to a rhythm of the runner's steps.

Thus, it is desired to have a method for processing music in order to adjust it to a rhythm of a runner without any unpleasant sound effects. Accordingly, there is a need in the art for a method for matching a rhythm of the music to a rhythm of steps of a runner or a walker.

SUMMARY OF THE INVENTION

Accordingly, the present invention is directed to a method for processing the music in order to match a rhythm of steps of a runner that substantially obviates one or more of the disadvantages of the related art.

In one aspect, a rhythm of any music is adjusted to match a running rhythm of a person on-the-fly. Even if a running rhythm changes during the same run, the rhythm of the music is changed without changing the sound and the key or the pitch of the music.

A music file is converted into a universal PCM format and divided into a set of overlapping windows. For each window a fingerprint vector is calculated from characteristics of sound signal in the window. The obtained vector-valued function is then analyzed to detect the repeating patterns. The time interval between the patterns is considered as multiplicative inverse of the song tempo at the moment of time when these patterns appear. The characteristic rhythm of the whole song is calculated using statistical analysis of tempo values for different parts of the song.

The runner's steps are analyzed using an accelerometer in the smartphone (e.g., an iPhone or Android-based phone). Then, a special coefficient is calculated in order to either speed up or slow down the music for matching it to the rhythm of the runner's steps.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF EMBODIMENTS OF THE INVENTION

Figure 1:
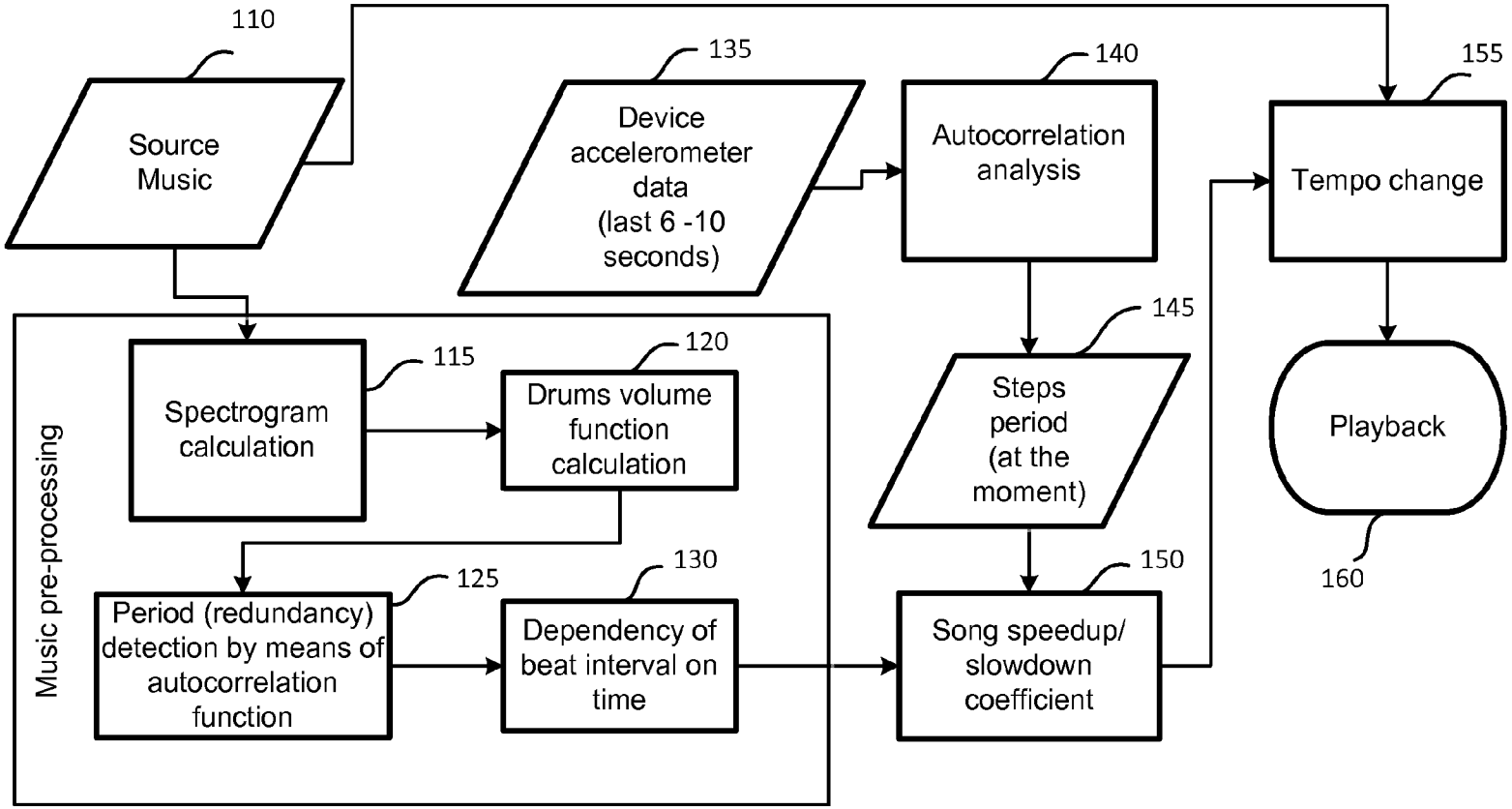
FIG. 1 illustrates a music processing algorithm, in accordance with the exemplary embodiment.

Reference will now be made in detail to the embodiments of the present invention, examples of which are illustrated in the accompanying drawings.

The present invention is directed to a method for processing music in order to match its rhythm to the rhythm of the runner's (or walker's) steps.

The music record is processed to estimate perceived rhythm interval for each moment of time. To calculate the rhythm interval, the music file in converted into a universal PCM format and divided into a set of overlapping windows. The length of the window and the step is determined by the characteristics of input music file. For each window a fingerprint vector that represents perceptive characteristics of the sound signal in the window. The vector is assigned to the moment of time corresponding to the middle of the window. The result of this procedure is a vector-valued function of time representing changes of some hearable characteristics of the music. The function is analyzed to detect repeating patterns. The frequency of these repetitions is considered as an one of possible tempo values for the corresponding moment of time. The values can be stored in a special database on the mobile device or accessed from an Internet service. Finally, the characteristic tempo of the whole file is calculated using statistical analysis of the tempo values for different parts of the file. Parts of the file where no tempo values detected are marked as parts without tempo.

Different formulae for the fingerprint calculation may be used to achieve better analysis results for different music genres. For example, energy of high frequency part of the spectrum can be used as estimation of drums volume, formants position can be used for vocal parties.

A runner's steps are analyzed using an accelerometer in a smartphone or in a music player. Then, a special coefficient is calculated in order to either speed up or slow down the music for matching it to the rhythm of the runner's steps. The steps are analyzed on-the-fly using the last 5-10 seconds. The step interval is determined using autocorrelation function or any other method of detecting repeating patterns in a function. Note that a mobile phone can be attached to the runner's arm or the shoulder, to reduce the amount of free movement or bouncing in a runner's pocket. Alternatively, user arm swings can be used for determination of the rhythm of movements.

Generally, an accelerometer in a smartphone provides sufficiently accurate data for the task. The mobile phone has a built-in accelerometer. A graph of absolute values produced by the accelerometer is generated using a maximum frequency allowed by the accelerometer. For example, this frequency may be in a range of 8 to 50 Hz. Note that if the frequency is low, it takes longer to determine step interval (i.e., rhythm). A step interval is calculated by using an autocorrelation function.

Subsequently, the music is processed in order to match the rhythm of the steps. The main (basic) rhythm of the music S is determined (or taken from the database). The rhythm of the runner's steps P is produce by the accelerometer. According to the exemplary embodiment, a music adjustment coefficient is calculated as follows:

$$K=P/S$$

The coefficient determines whether the music needs to be sped up or slowed down. If K>=1, the music needs to be sped up by K times. If K<1, the music needs to be slowed down by K times.

According to the exemplary embodiment, the music can be adjusted only within certain limits, which are selected empirically, to avoid too much distortion of the music. Thus, the coefficient K is adjusted as follows:

If K<=minMultiplicator, then K increases proportionally;

If K>=maxMultiplicator, then K:=K decreases proportionally;

Note that the above coefficient threshold values can be different, depending on the song—e.g., some songs have a fast rhythm, some a slow one, and so on.

For example, minMultiplicator and maxMultiplicator might be equal to 0.6 and 1.8 for particular tracks and usage scenarios as empirically defined limits of comfortable listening to music.

Proportional increasing and decreasing of K in simple cases may be described as multiplication by 2 and division by 2, but generally the algorithm can also use more flexible scenarios.

In additional, if a user's tempo is stable enough, the algorithm may also apply small corrections to K to force drums in the track to bang exactly in the moments of pushing of user's legs, providing full synchronization between both rhythms.

Changes in the tempo of source music can result in reduced sound quality. The more the source music is slowed down or sped up, the more noticeable are sound deviations from the original sound. In order to keep the sound deviations within an acceptable range, the playback speed coefficient is limited by maximum and minimum values. Note that maximum value has to be larger than the minimum value by more than 2, in order to match practically any running tempo with any song rhythm. The values 0.6 and 1.8 (used above) are just exemplary values. The actual values are selected empirically for particular devices.

According to the exemplary embodiment, a degree of stability of a song tempo and a presence, number and frequency of changes in tempo are determined. These analyses basically determine how suitable a given song is for running. The tempo stability parameter indicates a degree of possible sound deviations caused by changes in tempo to match the runner's tempo.

Each song from a user media library is assigned a quality indicator reflecting usability of the song for running based on the tempo stability parameter. The quality indicator, the main tempo parameter and the song id are stored in the database. This data is used for recommending the suitable songs to a runner.

The song analysis can determine the main rhythm of a song—i.e., a value of rhythm corresponding to a large portion of the song (e.g., 60-70%). According to the exemplary embodiment, the system can shuffle the songs in such a way that the songs that are less affected by rhythm changes are offered to the runner first based on his typical running rhythm or based on a type of training required. The rhythm can be determined automatically, or the user can enter his preferences (e.g., "jogging", "walking", "sprint"). This may help to estimate better what user wants to do at the present moment. As another alternative, programmable training permits the user to set the rhythm and then all tracks are be sped up/slowed down for the rhythm (i.e., instead of calculation of the current BPM, the user is asked which tempo he wants).

According to the exemplary embodiment, the audio signal can be processed by a third party library, such as SoundTouch, to adjust playback speed without changing pitch. Once the coefficient K is applied to the music, the rhythm of the music matches the rhythm of the steps of the runner.

Note that the main (base) rhythm of the music can be calculated by matching sound signal with known spectral characteristics of the particular musical instruments and locating repeating patterns in this instrument role.

FIG. 1 illustrates a special case of the music processing algorithm which uses drums volume estimation (energy to high frequency part of the signal) as a fingerprint, in accordance with the exemplary embodiment. The source music 110 is analyzed using spectrogram calculation. The drums volume is calculated in step 120 as an energy of the high frequency part of the signal and is used in spectrogram calculation 115. The possible rhythm values are determined by autocorrelation function using beat intervals in step 125. The values assigned to a corresponding moments of time in step 130. An accelerometer built into a mobile phone determines the rhythm of the runner's steps in step 135. The steps are analyzed on-the-fly using autocorrelation analysis in step 140.

The step interval for a present moment of time is determined from the accelerometer data for the last 6-10 seconds. Subsequently, the music (i.e., a song) adjustment coefficient is calculated in step 150. The current steps period is determined in step 145. The tempo of the original music is changed to match the rhythm of the steps in step 155. The adjusted music is played back to the runner in step 160.

Figure 2:
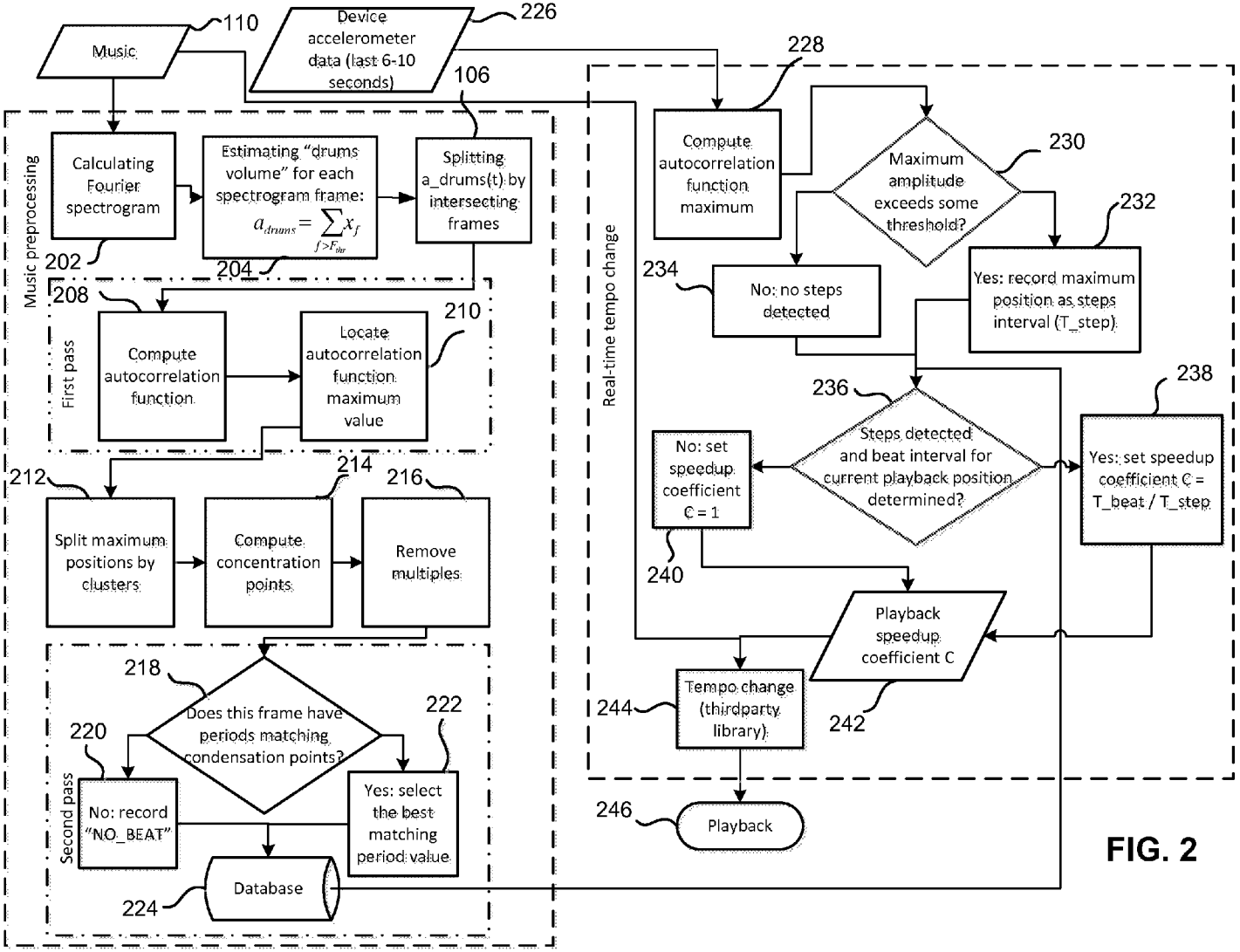
FIG. 2 illustrates a detailed flow chart of the algorithm depicted in FIG. 1.

FIG. 2 illustrates embodiment detailed flow chart of the algorithm depicted in FIG. 1. A music file 110 is processed. Fourier spectrogram is calculated in step 202. A drum volume is estimated for each spectrogram frame in step 204. Drum/percussion instrument sounds are frequently periodic, and its beat interval is attempted to be matched to the rhythm of the runner's movement. Its value is the average amplitude in a high frequency part of the spectrum. The drum volume is split by overlapping frames in step 206. After step (204), there is a defined dependence of the amplitude as a function of time, for percussion instruments.

This time dependency is divided into a number of (possibly overlapping) frames. Then, for each frame, an autocorrelation function is calculated. The maxima of this function are stored. Thus, after a first pass, there is a set of moments in time (middles of frames) and the maxima corresponding to these moments. One of these maxima is the needed value. The autocorrelation function is applied in step 208, and the autocorrelation function maximum values (peaks) are determined in step 210.

In step 212, the maximum positions are split by clusters and the concentration points are computed in step 214. The multiples are removed in step 216. If the music frame has periods matching condensation points (step 218), the best matching period value is selected in step 222 and recorded into a database 224. Otherwise, "no beat" is recorded in step 220. Initially, a hypothesis is made that there are sections of the song where the beat interval is approximately constant (which is usually true, for most songs). If many possible potential values of this period are considered (i.e., the maxima locations), for all moments in time, then the set of possible values can be divided into several groups surrounding the beat interval during these time periods.

If multiple counts are discarded (the autocorrelation function, for each period T, has a set of maxima nT, where n is an integer), then there are 1-2 groups of values remaining. For each moment in time, the maximum closest to the center of the group is chosen (if there are several maxima, the one with the highest amplitude is chosen). In the database, its location is stored as the beat interval for this moment in time. If there is no useful maximum, then there is no beat interval (for example, sections of a recording with only vocals, or with very complex instrument sequences).

In step 226, the accelerometer built into a mobile phone determines the rhythm of the runner's steps. The accelerometer takes data for the last 6-10 seconds. In step 228, the accelerometer computes autocorrelation function maximum amplitude. Then, if the maximum amplitude exceeds some threshold in step 230, the maximum position is recorded into as step interval T_step (i.e., rhythm) in step 232. It may be taken as 0.2 of the primary maximum, which is also selected empirically.

Otherwise, no steps are detected in step 234. If the steps are detected and a beat interval (T_beat) is determined for a current playback position in step 236, the speedup coefficient C is calculated as: C=T_beat/T_step. Otherwise, the speedup coefficient C=1 in step 240. In other words, the music can be both speeded up and slowed down.

The play back speed up coefficient C is applied to the music file in step 242. Subsequently, the tempo of the music is changed accordingly in step 244 using a third-party library. The adjusted music is played back in step 246.

According to another exemplary embodiment, the mobile phone application can analyze music tracks on-the-fly. This, however, may require a more powerful processor, and also may drain the battery faster. The coefficients can be determined empirically. For example, maximum values can be determined over longer time intervals (10-15 seconds). Note that other applications for determining the step period (i.e., rhythm) can be used.

Those skilled in the art will appreciate that the proposed method, advantageously, allows for adjustment of the music tempo to the rhythm of the runner's steps on-the-fly. This provides for more pleasant and efficient running or walking experience.

Figure 3:
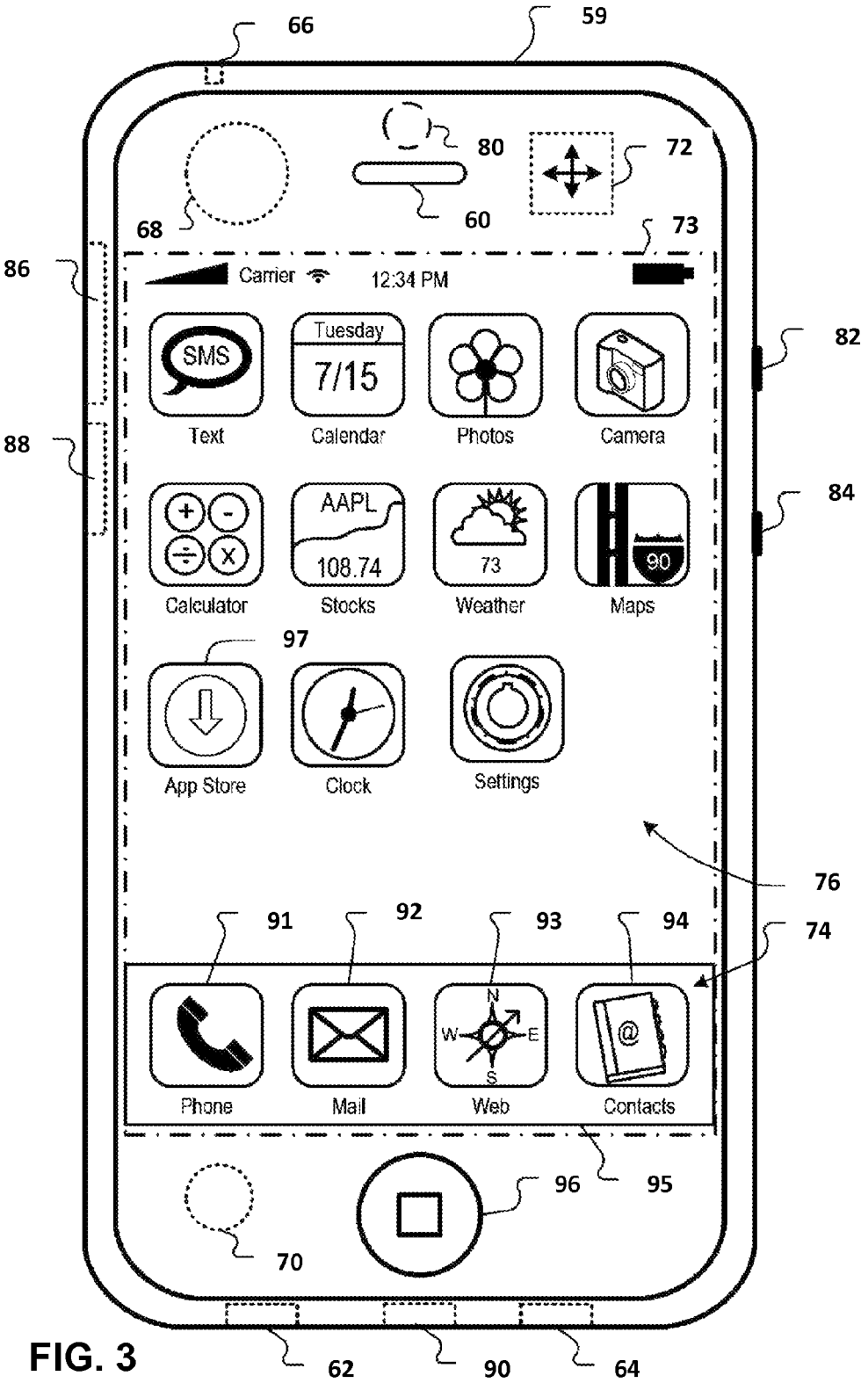
FIG. 3 is a block diagram of an exemplary mobile device that can be used in the invention.

FIG. 3 is a block diagram of an exemplary mobile device 59 on which the invention can be implemented. The mobile device 59 can be, for example, a personal digital assistant, a cellular telephone, a network appliance, a camera, a smart phone, an enhanced general packet radio service (EGPRS) mobile phone, a network base station, a media player, a navigation device, an email device, a game console, or a combination of any two or more of these data processing devices or other data processing devices.

In some implementations, the mobile device 59 includes a touch-sensitive display 73. The touch-sensitive display 73 can implement liquid crystal display (LCD) technology, light emitting polymer display (LPD) technology, or some other display technology. The touch-sensitive display 73 can be sensitive to haptic and/or tactile contact with a user.

In some implementations, the touch-sensitive display 73 can comprise a multi-touch-sensitive display 73. A multi-touch-sensitive display 73 can, for example, process multiple simultaneous touch points, including processing data related to the pressure, degree and/or position of each touch point. Such processing facilitates gestures and interactions with multiple fingers, chording, and other interactions. Other touch-sensitive display technologies can also be used, e.g., a display in which contact is made using a stylus or other pointing device.

In some implementations, the mobile device 59 can display one or more graphical user interfaces on the touch-sensitive display 73 for providing the user access to various system objects and for conveying information to the user. In some implementations, the graphical user interface can include one or more display objects 74, 76. In the example shown, the display objects 74, 76, are graphic representations of system objects. Some examples of system objects include device functions, applications, windows, files, alerts, events, or other identifiable system objects.

In some implementations, the mobile device 59 can implement multiple device functionalities, such as a telephony device, as indicated by a phone object 91; an e-mail device, as indicated by the e-mail object 92; a network data communication device, as indicated by the Web object 93; a Wi-Fi base station device (not shown); and a media processing device, as indicated by the media player object 94. In some implementations, particular display objects 74, e.g., the phone object 91, the e-mail object 92, the Web object 93, and the media player object 94, can be displayed in a menu bar 95. In some implementations, device functionalities can be accessed from a top-level graphical user interface, such as the graphical user interface illustrated in the figure. Touching one of the objects 91, 92, 93 or 94 can, for example, invoke corresponding functionality.

In some implementations, the mobile device 59 can implement network distribution functionality. For example, the functionality can enable the user to take the mobile device 59 and its associated network while traveling. In particular, the mobile device 59 can extend Internet access (e.g., Wi-Fi) to other wireless devices in the vicinity. For example, mobile device 59 can be configured as a base station for one or more devices. As such, mobile device 59 can grant or deny network access to other wireless devices.

In some implementations, upon invocation of device functionality, the graphical user interface of the mobile device 59 changes, or is augmented or replaced with another user interface or user interface elements, to facilitate user access to particular functions associated with the corresponding device functionality. For example, in response to a user touching the phone object 91, the graphical user interface of the touch-sensitive display 73 may present display objects related to various phone functions; likewise, touching of the email object 92 may cause the graphical user interface to present display objects related to various e-mail functions; touching the Web object 93 may cause the graphical user interface to present display objects related to various Web-surfing functions; and touching the media player object 94 may cause the graphical user interface to present display objects related to various media processing functions.

In some implementations, the top-level graphical user interface environment or state can be restored by pressing a button 96 located near the bottom of the mobile device 59. In some implementations, each corresponding device functionality may have corresponding "home" display objects displayed on the touch-sensitive display 73, and the graphical user interface environment can be restored by pressing the "home" display object.

In some implementations, the top-level graphical user interface can include additional display objects 76, such as a short messaging service (SMS) object, a calendar object, a photos object, a camera object, a calculator object, a stocks object, a weather object, a maps object, a notes object, a clock object, an address book object, a settings object, and an app store object 97. Touching the SMS display object can, for example, invoke an SMS messaging environment and supporting functionality; likewise, each selection of a display object can invoke a corresponding object environment and functionality.

Additional and/or different display objects can also be displayed in the graphical user interface. For example, if the device 59 is functioning as a base station for other devices, one or more "connection" objects may appear in the graphical user interface to indicate the connection. In some implementations, the display objects 76 can be configured by a user, e.g., a user may specify which display objects 76 are displayed, and/or may download additional applications or other software that provides other functionalities and corresponding display objects.

In some implementations, the mobile device 59 can include one or more input/output (I/O) devices and/or sensor devices. For example, a speaker 60 and a microphone 62 can be included to facilitate voice-enabled functionalities, such as phone and voice mail functions. In some implementations, an up/down button 84 for volume control of the speaker 60 and the microphone 62 can be included. The mobile device 59 can also include an on/off button 82 for a ring indicator of incoming phone calls. In some implementations, a loud speaker 64 can be included to facilitate hands-free voice functionalities, such as speaker phone functions. An audio jack 66 can also be included for use of headphones and/or a microphone.

In some implementations, a proximity sensor 68 can be included to facilitate the detection of the user positioning the mobile device 59 proximate to the user's ear and, in response, to disengage the touch-sensitive display 73 to prevent accidental function invocations. In some implementations, the touch-sensitive display 73 can be turned off to conserve additional power when the mobile device 59 is proximate to the user's ear.

Other sensors can also be used. For example, in some implementations, an ambient light sensor 70 can be utilized to facilitate adjusting the brightness of the touch-sensitive display 73. In some implementations, an accelerometer 72 can be utilized to detect movement of the mobile device 59, as indicated by the directional arrows. Accordingly, display objects and/or media can be presented according to a detected orientation, e.g., portrait or landscape. In some implementations, the mobile device 59 may include circuitry and sensors for supporting a location determining capability, such as that provided by the global positioning system (GPS) or other positioning systems (e.g., systems using Wi-Fi access points, television signals, cellular grids, Uniform Resource Locators (URLs)). In some implementations, a positioning system (e.g., a GPS receiver) can be integrated into the mobile device 59 or provided as a separate device that can be coupled to the mobile device 59 through an interface (e.g., port device 90) to provide access to location-based services.

The mobile device 59 can also include a camera lens and sensor 80. In some implementations, the camera lens and sensor 80 can be located on the back surface of the mobile device 59. The camera can capture still images and/or video.

The mobile device 59 can also include one or more wireless communication subsystems, such as an 802.11b/g communication device 86, and/or a BLUETOOTH communication device 88. Other communication protocols can also be supported, including other 802.x communication protocols (e.g., WiMax, Wi-Fi, 3G, LTE), code division multiple access (CDMA), global system for mobile communications (GSM), Enhanced Data GSM Environment (EDGE), etc.

In some implementations, the port device 90, e.g., a Universal Serial Bus (USB) port, or a docking port, or some other wired port connection, is included. The port device 90 can, for example, be utilized to establish a wired connection to other computing devices, such as other communication devices 59, network access devices, a personal computer, a printer, or other processing devices capable of receiving and/or transmitting data. In some implementations, the port device 90 allows the mobile device 59 to synchronize with a host device using one or more protocols, such as, for example, the TCP/IP, HTTP, UDP and any other known protocol. In some implementations, a TCP/IP over USB protocol can be used.

Figure 4:
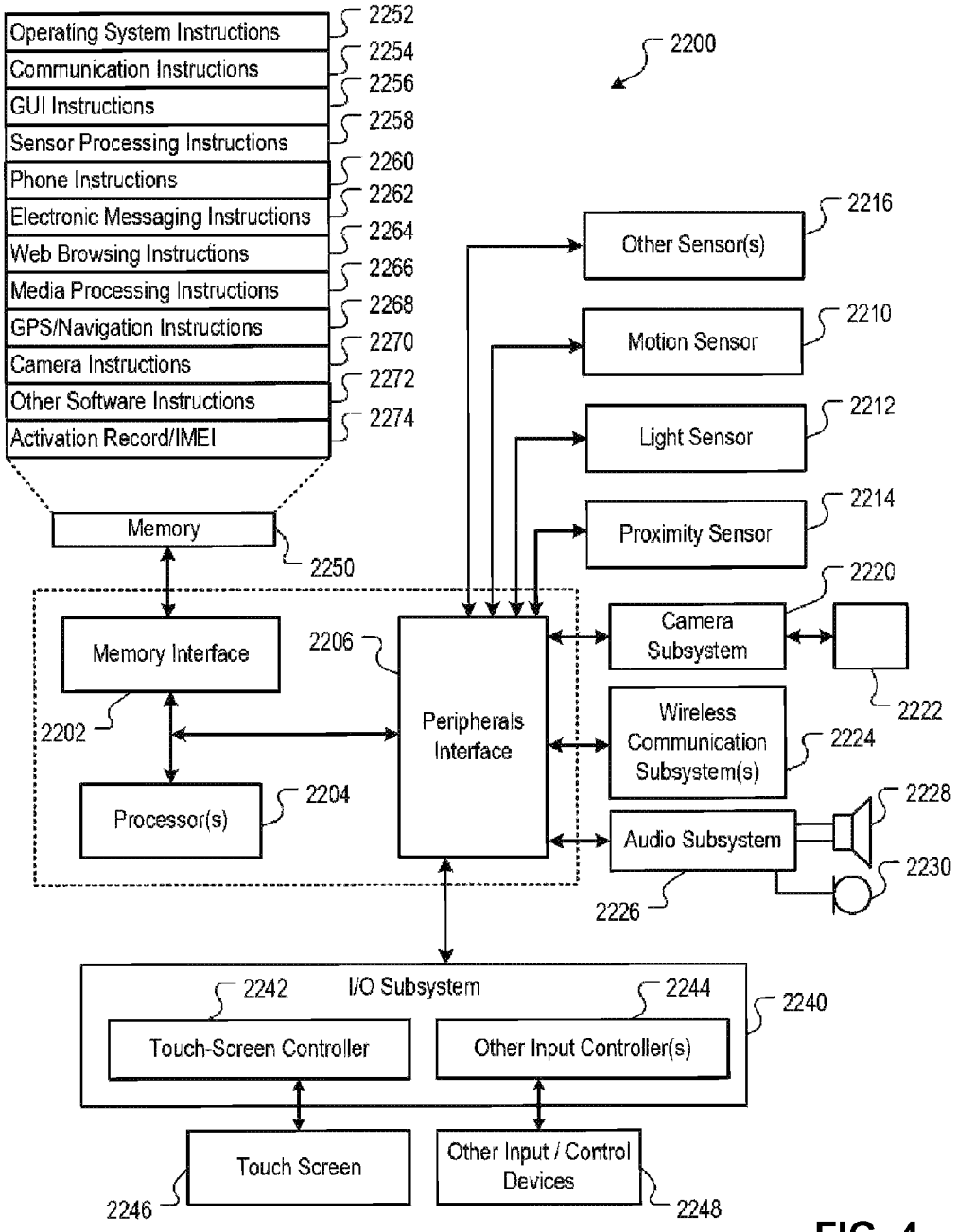
FIG. 4 is a block diagram of an exemplary implementation of the mobile device.

FIG. 4 is a block diagram 2200 of an example implementation of the mobile device 59. The mobile device 59 can include a memory interface 2202, one or more data processors, image processors and/or central processing units 2204, and a peripherals interface 2206. The memory interface 2202, the one or more processors 2204 and/or the peripherals interface 2206 can be separate components or can be integrated in one or more integrated circuits. The various components in the mobile device 59 can be coupled by one or more communication buses or signal lines.

Sensors, devices and subsystems can be coupled to the peripherals interface 2206 to facilitate multiple functionalities. For example, a motion sensor 2210, a light sensor 2212, and a proximity sensor 2214 can be coupled to the peripherals interface 2206 to facilitate the orientation, lighting and proximity functions described above. Other sensors 2216 can also be connected to the peripherals interface 2206, such as a positioning system (e.g., GPS receiver), a temperature sensor, a biometric sensor, or other sensing device, to facilitate related functionalities.

A camera subsystem 2220 and an optical sensor 2222, e.g., a charge-coupled device (CCD) or a complementary metal-oxide semiconductor (CMOS) optical sensor, can be utilized to facilitate camera functions, such as recording photographs and video clips.

Communication functions can be facilitated through one or more wireless communication subsystems 2224, which can include radio frequency receivers and transmitters and/or optical (e.g., infrared) receivers and transmitters. The specific design and implementation of the communication subsystem 2224 can depend on the communication network(s) over which the mobile device 59 is intended to operate. For example, a mobile device 59 may include communication subsystems 2224 designed to operate over a GSM network, a GPRS network, an EDGE network, a Wi-Fi or WiMax network, and a BLUETOOTH network. In particular, the wireless communication subsystems 2224 may include hosting protocols such that the device 59 may be configured as a base station for other wireless devices.

An audio subsystem 2226 can be coupled to a speaker 2228 and a microphone 2230 to facilitate voice-enabled functions, such as voice recognition, voice replication, digital recording, and telephony functions.

The I/O subsystem 2240 can include a touch screen controller 2242 and/or other input controller(s) 2244. The touch-screen controller 2242 can be coupled to a touch screen 2246. The touch screen 2246 and touch screen controller 2242 can, for example, detect contact and movement or break thereof using any of multiple touch sensitivity technologies, including but not limited to capacitive, resistive, infrared, and surface acoustic wave technologies, as well as other proximity sensor arrays or other elements for determining one or more points of contact with the touch screen 2246.

The other input controller(s) 2244 can be coupled to other input/control devices 2248, such as one or more buttons, rocker switches, thumb-wheel, infrared port, USB port, and/or a pointer device such as a stylus. The one or more buttons (not shown) can include an up/down button for volume control of the speaker 2228 and/or the microphone 2230.

In one implementation, a pressing of the button for a first duration may disengage a lock of the touch screen 2246; and a pressing of the button for a second duration that is longer than the first duration may turn power to the mobile device 59 on or off. The user may be able to customize a functionality of one or more of the buttons. The touch screen 2246 can, for example, also be used to implement virtual or soft buttons and/or a keyboard.

In some implementations, the mobile device 59 can present recorded audio and/or video files, such as MP3, AAC, and MPEG files. In some implementations, the mobile device 59 can include the functionality of an MP3 player. The mobile device 59 may, therefore, include a 32-pin connector that is compatible with the MP3 player. Other input/output and control devices can also be used.

The memory interface 2202 can be coupled to memory 2250. The memory 2250 can include high-speed random access memory and/or non-volatile memory, such as one or more magnetic disk storage devices, one or more optical storage devices, and/or flash memory (e.g., NAND, NOR). The memory 2250 can store an operating system 2252, such as Darwin, RTXC, LINUX, UNIX, OS X, ANDROID, IOS, WINDOWS, or an embedded operating system such as VxWorks. The operating system 2252 may include instructions for handling basic system services and for performing hardware dependent tasks. In some implementations, the operating system 2252 can be a kernel (e.g., UNIX kernel).

The memory 2250 may also store communication instructions 2254 to facilitate communicating with one or more additional devices, one or more computers and/or one or more servers. The memory 2250 may include graphical user interface instructions 2256 to facilitate graphic user interface processing including presentation, navigation, and selection within an application store; sensor processing instructions 2258 to facilitate sensor-related processing and functions; phone instructions 2260 to facilitate phone-related processes and functions; electronic messaging instructions 2262 to facilitate electronic-messaging related processes and functions; web browsing instructions 2264 to facilitate web browsing-related processes and functions; media processing instructions 2266 to facilitate media processing-related processes and functions; GPS/Navigation instructions 2268 to facilitate GPS and navigation-related processes and instructions; camera instructions 2270 to facilitate camera-related processes and functions; and/or other software instructions 2272 to facilitate other processes and functions.

Each of the above identified instructions and applications can correspond to a set of instructions for performing one or more functions described above. These instructions need not be implemented as separate software programs, procedures or modules. The memory 2250 can include additional instructions or fewer instructions. Furthermore, various functions of the mobile device 59 may be implemented in hardware and/or in software, including in one or more signal processing and/or application specific integrated circuits.

Having thus described the different embodiments of a system and method, it should be apparent to those skilled in the art that certain advantages of the described method and apparatus have been achieved.

It should also be appreciated that various modifications, adaptations, and alternative embodiments thereof may be made within the scope and spirit of the present invention. The invention is further defined by the following claims.

What is claimed is:

1. A method for matching a tempo of music to a runner's rhythm, the method comprising:

loading a music file into a mobile device;

attaching a mobile device to a person;

converting the music file into a universal PCM format;

splitting the music file into a set of overlapping windows;

applying a Discrete Fourier Transformation for each window;

calculating an energy of a high frequency portion within each Fourier spectrum;

using the calculated energy as the fingerprint at a corresponding offset from the beginning of the music file;

locating repeating patterns in different parts of the fingerprint using autocorrelation function;

using a frequency of the patterns repetition as a possible tempo value at the corresponding offset in the music file;

defining a main music rhythm using statistical analysis of possible tempo values;

detecting a rhythm of person's steps using autocorrelation analysis of accelerometer and/or gyroscope data;

calculating a music adjustment coefficient K by dividing the music rhythm by the movement rhythm;

applying the music adjustment coefficient K to the music file; and playing back the music file using a tempo adjusted by the music adjustment coefficient K.

2. The method of claim 1, wherein the music rhythm is stored in a database.

3. The method of claim 1, wherein a fingerprint is calculated for each frame of the Fourier spectrum prior to the determining of the peaks of the autocorrelation function.

4. The method of claim 1, wherein the tempo of the music is sped up by the application of the K, if the K>=1.

5. The method of claim 1, wherein the tempo of the music is slowed down by the application of the K, if the K<1.

6. A system for matching a tempo of music to a runner's rhythm, the system comprising:

a mobile device configured to receive a music file;

an accelerometer integrated in the mobile device, the accelerometer configured to detect a rhythm or person's steps;

a music processing module executed on the mobile device; and a play back module integrated into a module device, wherein:

the mobile device receives the music file and provides it to the music processing module;

the music processing module acquires the rhythm data from the accelerometer;

the music processing module calculates a music adjustment coefficient based on the rhythm data and applies it to the music file; and the play back module plays the adjusted music file, wherein the music processing module is configured to perform the following steps:

converting the music file into a universal format;

applying a Discrete Fourier Transformation to the music file;

calculating a Fourier spectrum for the music file;

calculating an average amplitude for a high frequency portion within each Fourier spectrum and using it as a fingerprint;

composing a fingerprint function from the music file;

determining repeating patterns in the fingerprint function;

calculating a rhythm of the song for each moment of time from the interval of repeating patterns in the fingerprint function;

defining a main music rhythm based on statistical analysis of rhythm values of different parts of the music file;

determining repeating patterns in real-time data received from accelerometer or gyroscope using autocorrelation function; and calculating a person's step interval from repeating patterns interval.

7. The system of claim 6, wherein the music processing module calculates the music adjustment coefficient by dividing a music rhythm by the movement rhythm.

8. The system of claim 6, wherein a user-defined movement rhythm is used for calculation of the music adjustment coefficient.

9. The system of claim 6, wherein the music processing module handles any of detected exceptions:

sharp changes in a music tempo; and abrupt changes in a movement rhythm.

10. The system of claim 9, wherein the music processing module applies the music adjustment coefficient regardless of the detected exceptions.

* * * * *